US010582748B1

(12) United States Patent
Finley

(10) Patent No.: US 10,582,748 B1
(45) Date of Patent: Mar. 10, 2020

(54) MULTIPLE KEY FOB HOLDER

(71) Applicant: Michael L. Finley, Fort Worth, TX (US)

(72) Inventor: Michael L. Finley, Fort Worth, TX (US)

( * ) Notice: Subject to any disclaimer, the term of this patent is extended or adjusted under 35 U.S.C. 154(b) by 126 days.

(21) Appl. No.: 15/926,084

(22) Filed: Mar. 20, 2018

(51) Int. Cl.

| | |
|---|---|
| ***A45C 11/32*** | (2006.01) |
| ***A45C 1/08*** | (2006.01) |
| ***A45C 13/02*** | (2006.01) |
| ***A45C 13/10*** | (2006.01) |
| *A45C 1/02* | (2006.01) |

(52) U.S. Cl.
CPC ..... *A45C 11/32* (2013.01); *A45C 11/321* (2013.01); *A45C 11/325* (2013.01); *A45C 11/326* (2013.01); *A45C 13/02* (2013.01); *A45C 13/023* (2013.01); *A45C 13/1046* (2013.01); *A45C 2001/026* (2013.01); *A45C 2001/086* (2013.01); *A45C 2013/1061* (2013.01)

(58) Field of Classification Search
CPC ..... A45C 1/08; A45C 2001/083; A45C 2001/086; A45C 2001/026; A45C 13/02; A45C 13/023; A45C 13/038; A45C 13/1038; A45C 13/1046; A45C 13/1053; A45C 11/32; A45C 11/321; A45C 11/325; A45C 11/326; A45C 2013/025; A45C 2013/026; A45C 2013/028; A45C 2013/1061
USPC ..... 206/38.1, 38, 234, 235
See application file for complete search history.

(56) References Cited

U.S. PATENT DOCUMENTS

| | | | | |
|---|---|---|---|---|
| 2,203,830 | A | 6/1940 | Leue | |
| 2,629,251 | A | 2/1953 | Schwalberg | |
| 4,153,093 | A | 5/1979 | Mahabir | |
| 4,161,201 | A | 7/1979 | Carp | |
| 4,192,365 | A | 3/1980 | Siegel | |
| 4,799,587 | A * | 1/1989 | Desanto | A45C 11/32 206/37.6 |
| D321,784 | S | 11/1991 | White | |
| 5,533,656 | A | 7/1996 | Bonaldi | |
| 7,441,977 | B2 * | 10/2008 | Merzon | A45C 13/02 206/473 |
| 2003/0053721 | A1 | 3/2003 | Goldman | |
| 2005/0016647 | A1 * | 1/2005 | Carey | A45C 1/08 150/113 |

(Continued)

FOREIGN PATENT DOCUMENTS

| | | |
|---|---|---|
| WO | 9613997 | 5/1996 |

*Primary Examiner* — Andrew D Perreault

(57) ABSTRACT

The multiple key fob holder is a case which stores a plurality of key fobs. The multiple key fob holder comprises a base, a cover, a master fastener, and a cord loop. The base and the cover form an enclosed containment structure within which the plurality of key fobs are contained. The base and the cover attach such that the cover rotates relative to the base. The master fastener attaches the base to the cover such that the containment structure can be secured in a closed position and unsecured to form an open position. The cord loop is a loop structure positioned at a location selected from the group consisting of: 1) the interior of the containment structure when the multiple key fob holder is in a closed position; and, 2) the exterior of the containment structure when the multiple key fob holder is in an open position.

11 Claims, 4 Drawing Sheets

(56) References Cited

U.S. PATENT DOCUMENTS

| | | | |
|---|---|---|---|
| 2006/0091030 | A1 | 5/2006 | Tawanapoor |
| 2017/0208905 | A1 | 7/2017 | Viskup |

* cited by examiner

MULTIPLE KEY FOB HOLDER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles including traveling articles, more specifically, a bag for holding a key fob.

SUMMARY OF INVENTION

The multiple key fob holder is a domestic article. The multiple key fob holder is configured for use with a plurality of key fobs. The multiple key fob holder is a portable case in which are stored the plurality of key fobs. The multiple key fob holder comprises a base, a cover, a master fastener, and a cord loop. The base and the cover form an enclosed containment structure within which the plurality of key fobs are contained. The base and the cover are permanently attached such that the cover rotates relative to the base. The master fastener attaches the base to the cover such that the containment structure can be secured in a closed position and unsecured to form an open position. The cord loop is a loop structure that can be positioned at a location selected from the group consisting of: 1) the interior of the containment structure when the multiple key fob holder is in a closed position; and, 2) the exterior of the containment structure when the multiple key fob holder is in an open position.

These together with additional objects, features and advantages of the multiple key fob holder will be readily apparent to those of ordinary skill in the art upon reading the following detailed description of the presently preferred, but nonetheless illustrative, embodiments when taken in conjunction with the accompanying drawings.

In this respect, before explaining the current embodiments of the multiple key fob holder in detail, it is to be understood that the multiple key fob holder is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the multiple key fob holder.

It is therefore important that the claims be regarded as including such equivalent construction insofar as they do not depart from the spirit and scope of the multiple key fob holder. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
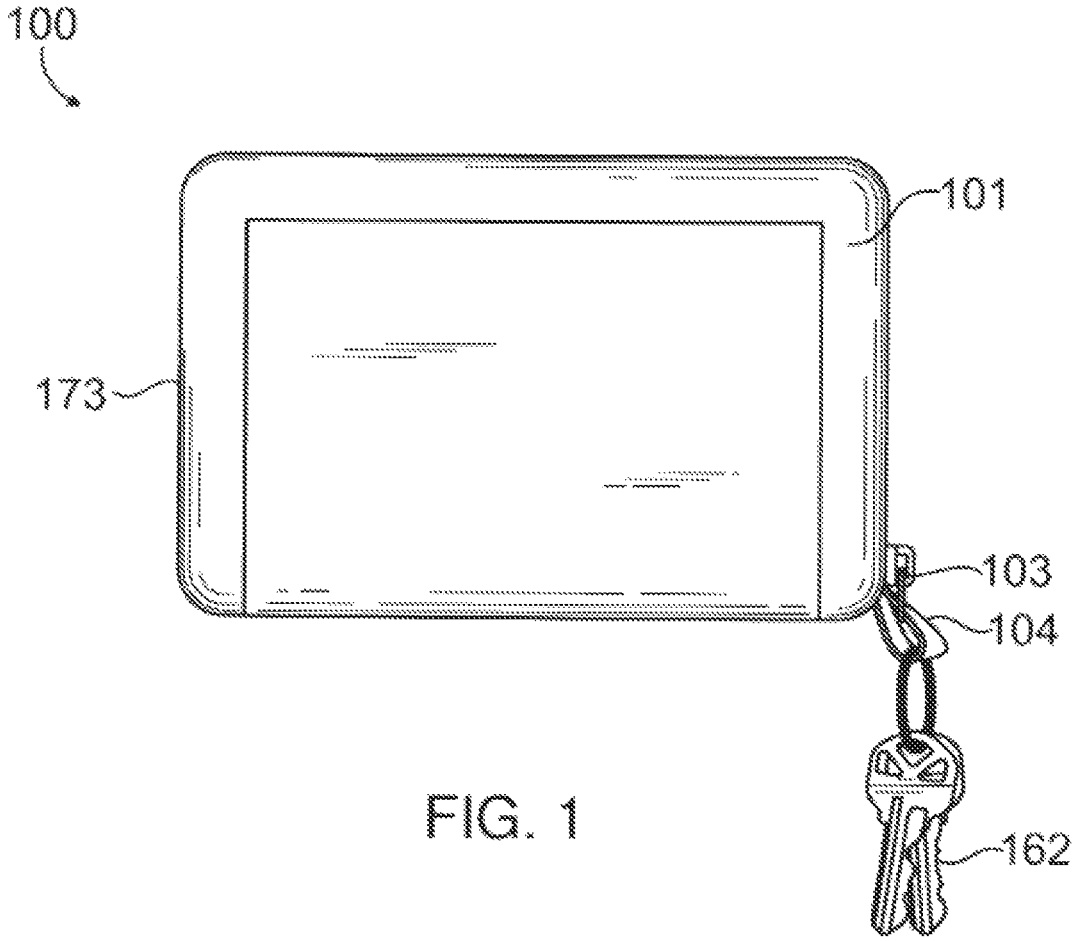
FIG. 1 is a closed front view of an embodiment of the disclosure.
Figure 2:
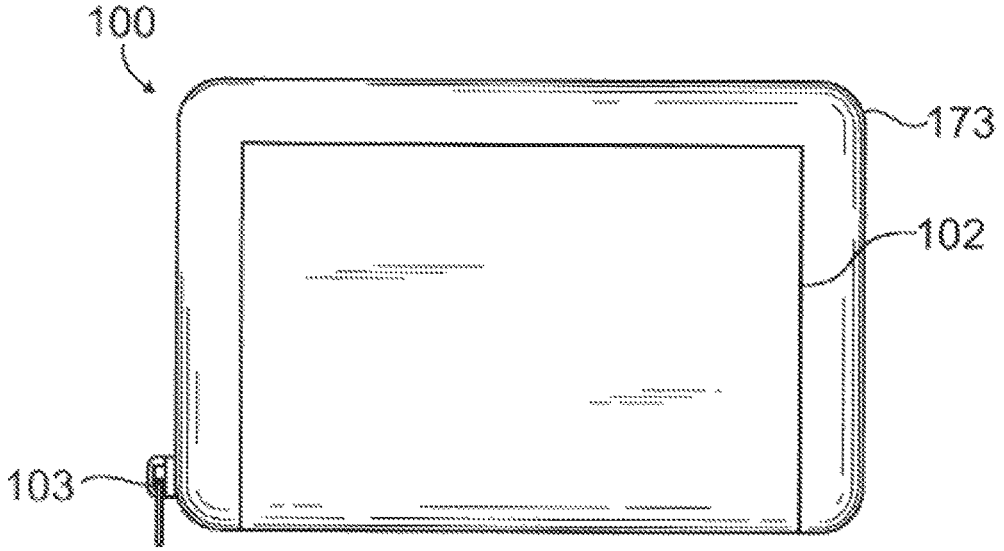
FIG. 2 is a closed front view of an alternate configuration of an embodiment of the disclosure.
Figure 3:
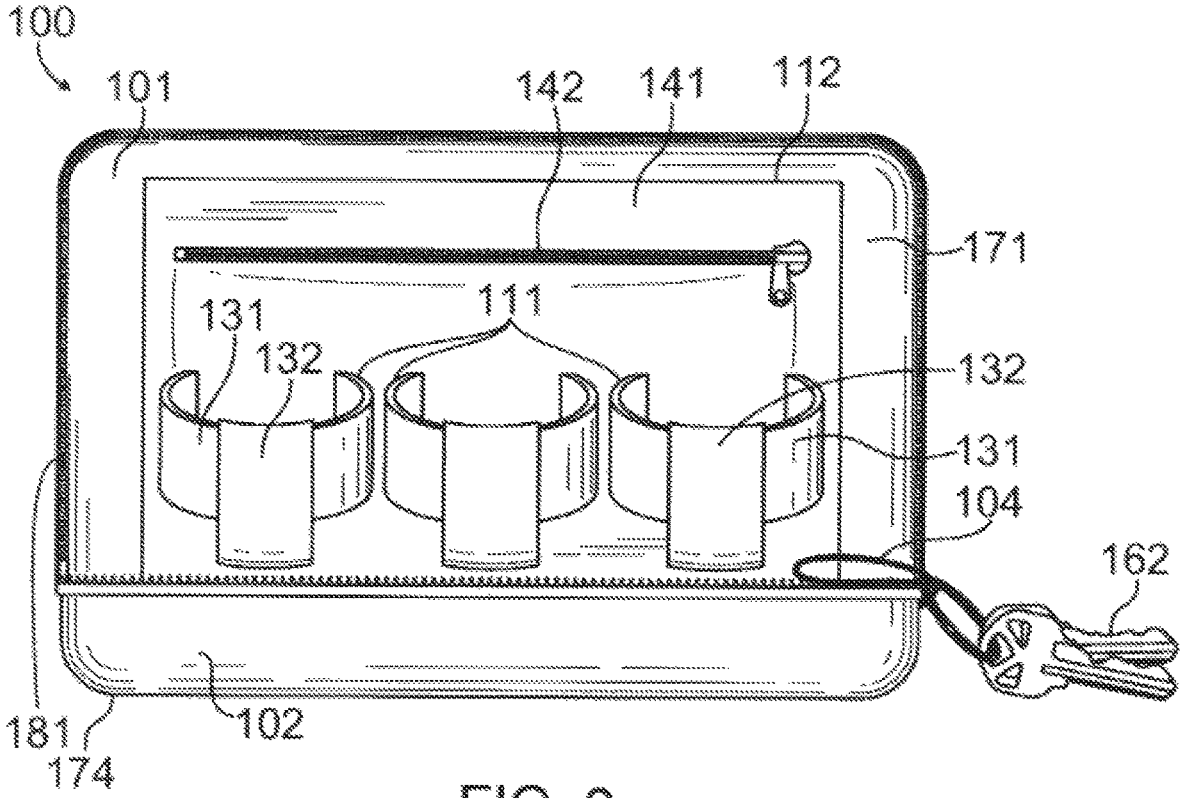
FIG. 3 is an open front view of an embodiment of the disclosure.
Figure 4:
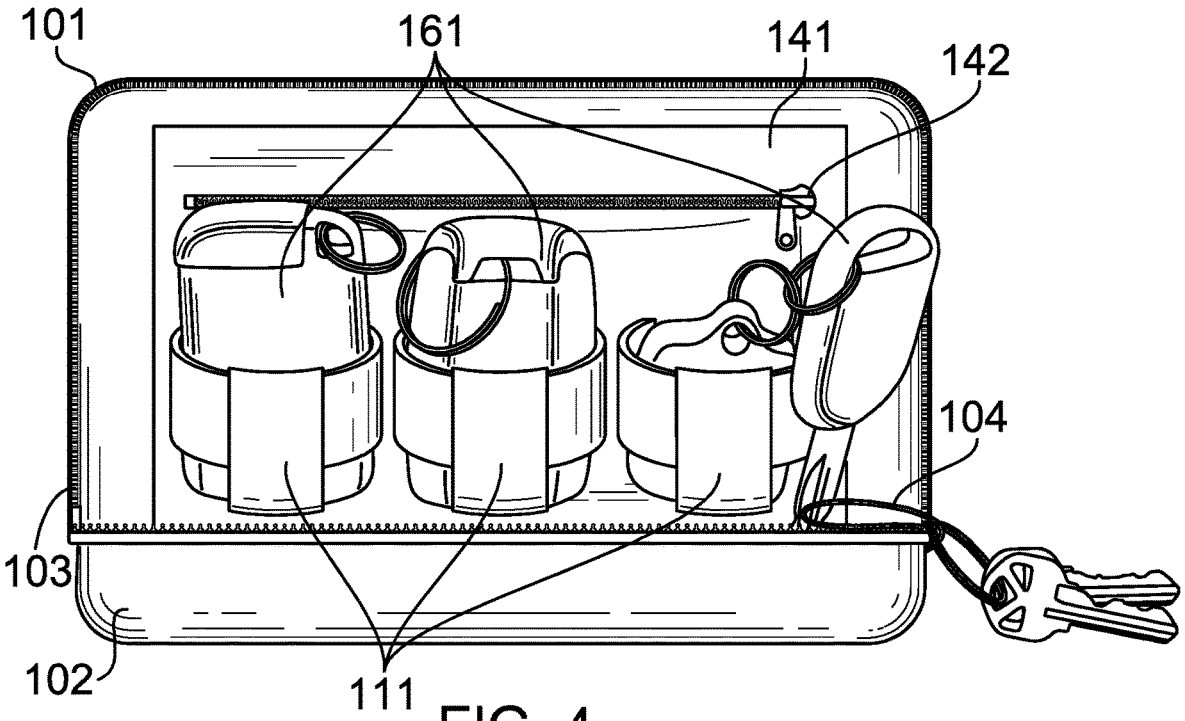
FIG. 4 is an open front in-use view of an embodiment of the disclosure.
Figure 5:
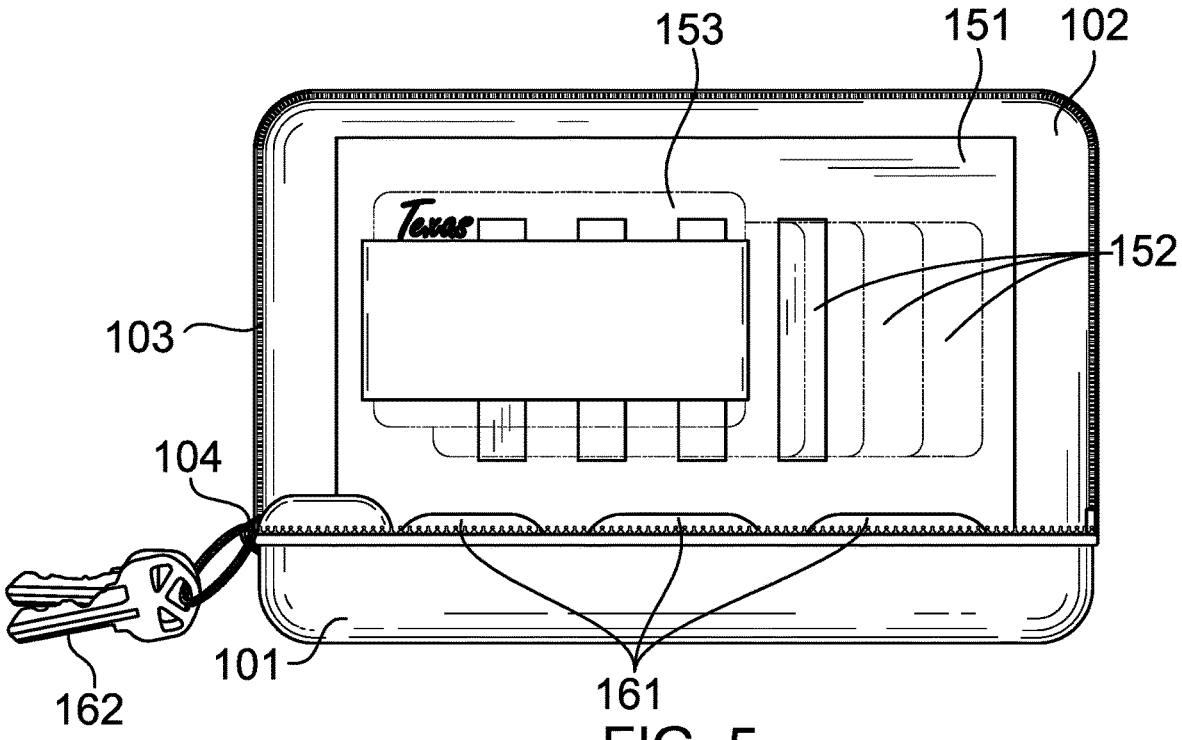
FIG. 5 is a top open view of an embodiment of the disclosure.
Figure 6:
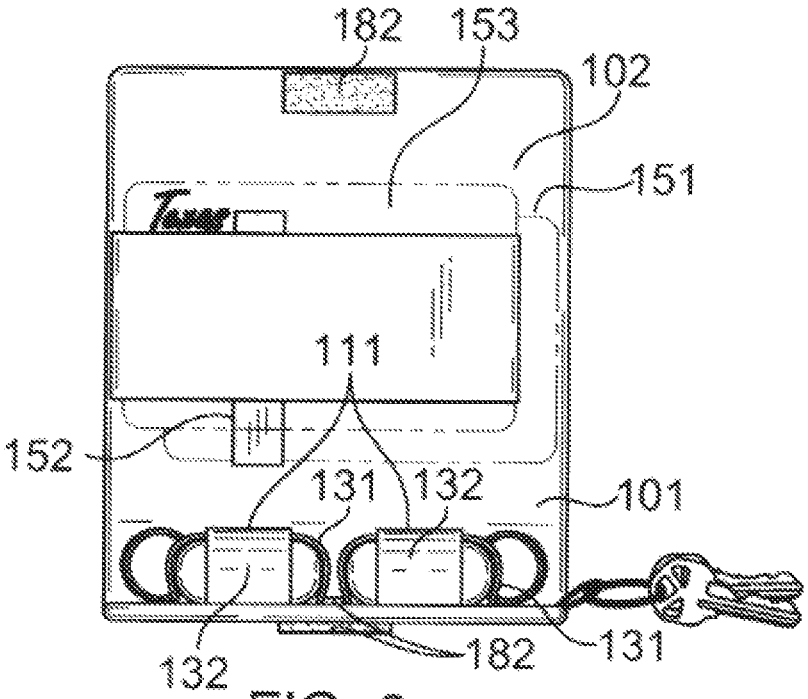
FIG. 6 is a top open view of an alternate embodiment of the disclosure.
Figure 7:
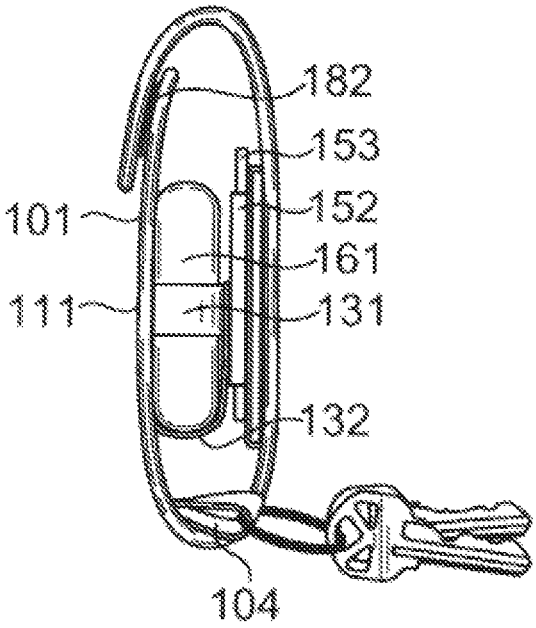
FIG. 7 is a side view of an embodiment of the disclosure.

Detailed reference will now be made to one or more potential embodiments of the disclosure, which are illustrated in FIGS. 1 through 7.

The multiple key fob holder 100 (hereinafter invention) is a domestic article. The invention 100 is configured for use with a plurality of key fobs 161. The key fob is defined in greater detail elsewhere in this disclosure. The invention 100 is a portable case in which are stored the plurality of key fobs 161. The invention 100 comprises a base 101, a cover 102, a master fastener 103, and a cord loop 104. The base 101 and the cover 102 form an enclosed containment structure within which the plurality of key fobs 161 are contained. The base 101 and the cover 102 are permanently attached such that the cover 102 rotates relative to the base 101.

The master fastener 103 attaches the base 101 to the cover 102 such that the containment structure can be secured in a closed position 173 and unsecured to form an open position 174. The invention 100 is further defined with a closed position 173 and an open position 174. The cord loop 104 is a loop structure that can be positioned at a location selected from the group consisting of: 1) the interior of the containment structure when the invention 100 is in a closed position 173; and, 2) the exterior of the containment structure when the invention 100 is in an open position 174. The closed position 173 is defined in greater detail elsewhere in this disclosure. The open position 174 is defined in greater detail elsewhere in this disclosure.

The base 101 is a plate structure. The base 101 forms approximately half of the exterior surface of the containment structure formed by the invention 100. The base 101 is formed as a semi-rigid structure. The plurality of key fobs 161 attach to the structure formed by the base 101. The base 101 comprises a plurality of holsters 111 and a coin purse 112. The base 101 is further defined with a first interior surface 171. The first interior surface 171 refers to the surface of the base 101 that is proximal to the cover 102 when the invention 100 folds into the closed position 173.

Each of the plurality of holsters 111 is an elastomeric structure. Each of the plurality of holsters 111 are identical. Each of the plurality of holsters 111 attach to the first interior surface 171 of the base 101 such that the plurality of holsters 111 are contained within the interior of the containment space when the invention 100 is closed. Each of the plurality of holsters 111 secures a key fob selected from the plurality of key fobs 161 to the base 101. Each of the plurality of holsters 111 comprises an elastic loop 131 and a stay webbing 132.

The elastic loop 131 is a commercially available elastic webbing. Each free end of the elastic loop 131 attaches to the base 101 to form the loop structure of the elastic loop 131. The primary sense of direction of the elastic loop 131 is parallel to the bound edges of the cover 102 and the base 101.

The elastic loop 131 acts as a spring. When a key fob selected from the plurality of key fobs 161 inserts into the elastic loop 131, a force is applied to the elastic loop 131 in a direction parallel to the length direction of the elastic loop 131, and the applied force elongates the span of the end to end length the elastic loop 131. The elasticity of the elastic loop 131 creates a force that opposes the displacement created by the applied force. The elasticity force of the elastic loop 131 returns the elastic loop 131 to its relaxed shape. When the elongated elastic loop 131 is wrapped around the selected key fob, the selected key fob will prevent the elastic loop 131 from returning to its relaxed shape. In this circumstance, the elastic loop 131 will apply a force projecting away from the length direction of the elastic loop 131 and against the selected key fob in a manner that binds the elastic loop 131 to the selected key fob.

The stay webbing 132 is a rigid webbing that attaches to both the elastic loop 131 and the base 101. The stay webbing 132 prevents the selected key fob from sliding out of the elastic loop 131 in a direction that is perpendicular to the primary sense of direction of the elastic loop 131. The primary sense of direction of the stay webbing 132 is perpendicular to the primary sense of direction of the elastic loop 131.

The coin purse 112 is a secured pocket formed on the first interior surface 171 of the base 101. The coin purse 112 is configured to store currency. The coin purse 112 comprises a first sheeting 141 and a first fastener 142.

The first sheeting 141 is a sheeting that forms a pouch on the first interior surface 171 of the base 101. The first sheeting 141 is sized to receive and store currency in paper and coin formats. The first fastener 142 is a commercially available fastener that secures the coin purse 112. The first fastener 142 is used to open and close the coin purse 112.

The cover 102 is a plate structure. The cover 102 forms approximately half of the exterior surface of the containment structure formed by the invention 100. The cover 102 and the base 101 are geometrically similar. The cover 102 folds on to the base 101 to form the closed position 173. The cover 102 comprises a flat pocket 121. The cover 102 is further defined with a second interior surface 172. The second interior surface 172 refers to the surface of the cover 102 that is proximal to the base 101 when the invention 100 is folded into the closed position 173.

The flat pocket 121 is a pocket structure that is configured to hold flat items such as identification cards and one or more credit cards 153. The one or more credit cards 153 are defined in greater detail elsewhere in this disclosure. The flat pocket 121 attaches to the second interior surface 172 of the cover 102. The flat pocket 121 comprises a second sheeting 151 and a plurality of card holders 152.

The second sheeting 151 is an elastic sheeting. The second sheeting 151 attaches to the second interior surface 172 of the cover 102. Each of the plurality of card holders 152 is a slit formed in the second sheeting 151. Each of the plurality of card holders 152 is identical. Each of the plurality of card holders 152 is sized to receive and store a credit card selected from the one or more credit cards 153.

Each of the plurality of card holders 152 is sized such that the selected credit card deforms selected card holder as the selected credit card inserts into the selected card holder. The elasticity of the selected card holder creates a force that opposes the displacement force created by the selected credit card. The elasticity force of the selected card holder returns the selected card holder to return to its relaxed shape. When the elongated selected card holder wraps around the selected credit card, the selected credit card will prevent the selected card holder from returning to its relaxed shape. In this circumstance, the selected card holder will apply a force against the selected credit card that binds the selected card holder to the selected credit card.

In the first potential embodiment of the disclosure, a living hinge attaches the cover 102 to the base 101 such that the cover 102 can be folded on to the base 101 to form the containment structure.

In a second potential embodiment of the disclosure, the base 101 and the cover 102 are formed from a single plate that allows the cover 102 to fold on to the base 101 to form the closed position 173. The single plate that forms the cover 102 is a semi-rigid structure that allows the cover 102 to fold on to the base 101.

The master fastener 103 is a commercially available fastener that attaches the cover 102 to the base 101 to form the containment structure of the invention 100. The master fastener 103 holds the invention 100 in the closed position 173.

In the first potential embodiment of the disclosure, the master fastener 103 is a zipper 181. The zipper 181 attaches the free edges of the cover 102 and the base 101. By free edges is meant the edges of the cover 102 and the base 101 that are not bound together by the living hinge. The zipper 181 is defined in greater detail elsewhere in this disclosure.

In the second potential embodiment of the disclosure, the master fastener 103 is a hook and loop fastener 182. The hook and loop fastener 182 attaches the edge of the cover 102 that is distal from the bound edges to the edge of the base 101 that is distal from the bound edges. As shown most clearly in FIGS. 6 and 7, the remaining edges of the cover 102 and the base 101 remain open into the interior of the containment structure when the invention 100 is in the closed position 173. The hook and loop fastener 182 is defined in greater detail elsewhere in this disclosure.

The cord loop 104 is a cord. The cord loop 104 forms a loop that attaches to a location selected from the group consisting of the base 101 and the cover 102. The cord loop 104 is a flexible structure that takes a position selected from the group consisting of: 1) the interior of the containment structure when the invention 100 is in the closed position 173; and, 2) the exterior of the containment structure when the invention 100 is in the closed position 173. The cord loop 104 forms an anchor point to which domestic articles such as one or more keys 162 are anchored. In the first potential embodiment of the disclosure, the cord loop 104 is an elastic cord.

The following definitions were used in this disclosure:

Anchor: As used in this disclosure, anchor means to hold an object firmly or securely.

Anchor Point: As used in this disclosure, an anchor point is a location to which a first object can be securely attached to a second object.

Bind: As used in this disclosure, to bind is a verb that means to tie or secure a first object to a second object using a cord or webbing. Braid: As used in this disclosure, a braid is a flat, round or tubular narrow fabric made by intertwining a set of yarns in a definite pattern. As a verb, to braid refers to the process of forming a braid.

Card: As used in this disclosure, a card means a flat stiff piece of material that bears information. Typical materials used to make cards include, but are not limited to, heavy paper, cardboard, plastic coated paper, or thin plastic. While this disclosure allows for variations in the size of a card, it is anticipated that cards will approximate the size of a traditional deck of playing cards. The sides of the card that bear the information are called faces.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Closed Position: As used in this disclosure, a closed position refers to a movable barrier structure that is in an orientation that prevents passage through a port or an aperture. The closed position is often referred to as an object being "closed."

Cord: As used in this disclosure, a cord is a long, thin, flexible, and prism-shaped string, line, rope, or wire. Cords are made from yarns, piles, or strands of material that are braided or twisted together or from a monofilament (such as fishing line). Cords have tensile strength but are too flexible to provide compressive strength and are not suitable for use in pushing objects. String, line, cable, and rope are synonyms for cord.

Correspond: As used in this disclosure, the term correspond is used as a comparison between two or more objects wherein one or more properties shared by the two or more objects match, agree, or align within acceptable manufacturing tolerances.

Credit Card: As used in this disclosure, a credit card is a form of identification that enables a person bearing the card to purchase a good or service from a vendor on the basis of credit provided by either the vendor or a third party.

Domestic Article: As used in this disclosure, a domestic article is an item or object: 1) that is commonly found within a household; or, 2) that is commonly carried by a person. Examples of domestic articles include, but are not limited to, keys and key fobs, personal data devices, glasses, remote controls, or personal storage items such as purses, briefcases, wallets, or cases.

Elastic: As used in this disclosure, an elastic is a material or object that deforms when a force is applied to it and that is able to return to its relaxed shape after the force is removed. A material that exhibits these qualities is also referred to as an elastomeric material.

Elastic Cord: As used in this disclosure, an elastic cord is a cord that contains elastic yarns as some of the yarns that make up the cord. An elastic cord is constructed such that the elastic cord will stretch when a force is applied and will return to its original shape when after the force is removed. Shock cord and bungee cord are synonyms for elastic cord.

Elastic Textile: As used in this disclosure, an elastic textile is a textile that contains elastic yarns as some of the yarns that make up the textile. An elastic textile is constructed such that the elastic textile will stretch when a force is applied and will return to its original shape when after the force is removed.

Elastic Webbing: As used in this disclosure, an elastic webbing is a webbing that contains elastic yarns as some of the yarns that make up the webbing. An elastic webbing is constructed such that the elastic webbing will stretch when a force is applied and will return to its original shape when after the force is removed.

Exterior: As used in this disclosure, the exterior is used as a relational term that implies that an object is not contained within the boundary of a structure or a space.

Fastener: As used in this disclosure, a fastener is a device that is used to join or affix two objects. Fasteners generally comprise a first element which is attached to the first object and a second element which is attached to the second object such that the first element and the second element join to affix the first object and the second object. Common fasteners include, but are not limited to, hooks, zippers, magnets, snaps, buttons, buckles, quick release buckles, or hook and loop fasteners.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1. Always use Correspond and One to One Hook and Loop Fastener: As used in this disclosure, a hook and loop fastener is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fastens to the plurality of loops securely fastening the hook surface to the loop surface. A note on usage: when fastening two objects the hook surface of a hook and loop fastener will be placed on the first object and the matching loop surface of a hook and loop fastener will be placed on the second object without significant regard to which object of the two objects is the first object and which of the two objects is the second object. When the hook surface of a hook and loop fastener or the loop surface of a hook and loop fastener is attached to an object this will simply be referred to as the "hook/loop surface" with the understanding that when the two objects are fastened together one of the two objects will have a hook surface and the remaining object will have the loop surface.

Interior: As used in this disclosure, the interior is used as a relational term that implies that an object is contained within the boundary of a structure or a space.

Key Fob: As used in this disclosure, a key fob is a transmitting device used to unlock a locked structure. Key fobs are often said to provide "keyless entry."

Living Hinge: As used in this disclosure, refers to a single object that is formed out of elastomeric material that is divided into a first segment, a second segment and the living hinge. The elastic nature of the elastomeric material allows the living hinge to be flexed in the manner of a hinge allowing the first segment to rotate relative to the second hinge. The living hinge is a form of a flexure bearing. A material that is formed with a series of parallel living hinges is referred to as a kerf bending. A kerf bending formed in a plate allows the plate to be bent into a curved shape.

Lock: As used in this disclosure, a lock is a device that prevents the unauthorized entry into or operation of a device.

One to One: When used in this disclosure, a one to one relationship means that a first element selected from a first set is in some manner connected to only one element of a second set. A one to one correspondence means that the one to one relationship exists both from the first set the second set and from the second set to the first set. A one to one fashion means that the one to one relationship exists in only one direction.

Open Position: As used in this disclosure, an open position refers to a movable barrier structure that is in an orientation that allows passage through a port or an aperture. The open position is often referred to as an object being "open."

Orientation: As used in this disclosure, orientation refers to the positioning of a first object relative to: 1) a second object; or, 2) a fixed position, location, or direction.

Plate: As used in this disclosure, a plate is a smooth, flat and semi-rigid or rigid structure that has at least one dimension that: 1) is of uniform thickness; and 2) that appears thin relative to the other dimensions of the object. Plates often have a rectangular or disk-like appearance. As defined in this disclosure, plates may be made of any material, but are commonly made of metal, plastic, and wood. When made of wood, a plate is often referred to as a board.

Pocket: As used in this disclosure, a pocket is a small pouch or storage space formed into an object. Pockets are often formed by joining a second textile or a second sheeting to a first textile or a first sheeting, respectively, by sewing or heat sealing respectively. Methods to form pockets are well-known and documented in the textile and apparel arts.

Primary Sense of Direction: As used in this disclosure, the primary sense of direction of an object refers to a vector that: 1) passes through the center of the object; and, 2) refers to the primary or longest axis of an object. This definition intends to align with what people would normally call the forward direction of an object.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Relaxed Shape: As used in this disclosure, a structure is considered to be in its relaxed state when no shear, strain, or torsional forces are being applied to the structure.

Semi-Rigid Structure: As used in this disclosure, a semi-rigid structure is a solid structure that is stiff but not wholly inflexible and that will deform under force before breaking. A semi-rigid structure may or may not behave in an elastic fashion in that a semi-rigid structure need not return to a relaxed shape.

Sheeting: As used in this disclosure, a sheeting is a material, such as a textile, a plastic, or a metal foil, in the form of a thin flexible layer or layers.

Textile: As used in this disclosure, a textile is a material that is woven, knitted, braided or felted. Synonyms in common usage for this definition include fabric and cloth.

Webbing: As used in this disclosure, a webbing is strong, close woven or knitted fabric that is used for straps or belting. As used in this disclosure, webbing is a fully formed material that is only cut to length for use. Webbing is not formed by cutting broader materials into strips.

Zipper: As used in this disclosure, a zipper is a fastening device comprising two flexible strips with interlocking components that are opened and closed by pulling a slide along the two flexible strips.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A storage apparatus for one or more key fobs comprising:

a base, a cover, a master fastener, and a cord loop;

wherein the base and the cover form a containment structure;

wherein the containment structure is configured for use with a plurality of key fobs;
wherein the enclosed containment structure contains the plurality of key fobs;
wherein the base and the cover are permanently attached such that the cover rotates relative to the base;
wherein the permanently attached is referred to as bound edges;
wherein the storage apparatus for one or more key fobs is further defined with a closed position and an open position;
wherein the master fastener attaches the base to the cover such that the containment structure can be secured in said closed position and unsecured to form said open position;
wherein the cord loop is a loop structure;
wherein the base is a plate structure;
wherein the base forms a portion of the exterior surface of the containment structure;
wherein the base is formed as a semi-rigid structure;
wherein the plurality of key fobs attach to the base;
wherein the base further comprises a plurality of holsters and a coin purse;
wherein the plurality of holsters attach to the base;
wherein the coin purse attaches to the base;
wherein the base is further defined with a first interior surface;
wherein the cover is a plate structure;
wherein the cover forms a portion of the exterior surface of the containment structure;
wherein the cover and the base are geometrically similar;
wherein the cover folds on to the base to form the closed position;
wherein the cord loop is a cord;
wherein the cord loop forms a loop that attaches to a location selected from the group consisting of the base and the cover;
wherein the cord loop is a flexible structure that takes a position selected from the group consisting of: a) the interior of the containment structure when the storage apparatus for one or more key fobs is in the closed position; and, b) the exterior of the containment structure when the storage apparatus for one or more key fobs is in the closed position;
wherein each of the plurality of holsters secures a key fob selected from the plurality of key fobs to the base;
wherein each of the plurality of holsters is an elastomeric structure;
wherein each of the plurality of holsters are identical;
wherein each of the plurality of holsters attach to the first interior surface of the base such that the plurality of holsters are contained within the interior of the containment space when the storage apparatus for one or more key fobs is closed;
wherein the coin purse is a pocket;
wherein the coin purse is formed on the first interior surface of the base;
wherein each of the plurality of holsters comprises an elastic loop and a stay webbing;
wherein the elastic loop is a webbing;
wherein each free end of the elastic loop attaches to the base to form the loop structure of the elastic loop;
wherein a primary sense of direction of the elastic loop is parallel to the bound edges of the cover and the base;
wherein the elastic loop is an elastic webbing;
wherein the elastic loop binds the elastic loop to the selected key fob;
wherein the stay webbing is a rigid webbing;
wherein the stay webbing attaches to the elastic loop;
wherein the stay webbing attaches to the base;
wherein the stay webbing prevents the selected key fob from sliding out of the elastic loop.

2. The storage apparatus for one or more key fobs according to claim 1 wherein the stay webbing is perpendicular to the elastic loop.

3. The storage apparatus for one or more key fobs according to claim 2
wherein the coin purse comprises a first sheeting and a first fastener;
wherein the first sheeting is a sheeting;
wherein the first sheeting forms a pouch on the first interior surface of the base;
wherein the first sheeting is sized to receive and store currency in paper and coin formats;
wherein the first fastener secures the coin purse;
wherein the first fastener opens and closes the coin purse.

4. The storage apparatus for one or more key fobs according to claim 3
wherein the cover further comprises a flat pocket;
wherein the flat pocket attaches to the second interior surface of the cover;
wherein the cover is further defined with a second interior surface;
wherein the flat pocket is a pocket structure that is configured to hold one or more credit cards.

5. The storage apparatus for one or more key fobs according to claim 4
wherein the flat pocket comprises a second sheeting and a plurality of card holders;
wherein the plurality of card holders are formed in the second sheeting.

6. The storage apparatus for one or more key fobs according to claim 5
wherein the second sheeting is an elastic sheeting; wherein the second sheeting attaches to the second interior surface of the cover.

7. The storage apparatus for one or more key fobs according to claim 6
wherein each of the plurality of card holders is a slit formed in the second sheeting;
wherein each of the plurality of card holders is identical;
wherein each of the plurality of card holders is sized to receive and store a credit card selected from the one or more credit cards;
wherein each of the plurality of card holders is sized such that the selected credit card deforms selected card holder as the selected credit card inserts into the selected card holder;
wherein the selected card holder binds the selected card holder to the selected credit card;
wherein the cord loop forms an anchor point to which domestic articles are anchored.

8. The storage apparatus for one or more key fobs according to claim 7 wherein the cord loop is an elastic cord.

9. The storage apparatus for one or more key fobs according to claim 8
wherein a living hinge attaches the cover to the base such that the cover folds on to the base to form the containment structure;
wherein the master fastener is a zipper;
wherein the zipper attaches the free edges of the cover and the base;
wherein by free edges is meant the edges of the cover and the base that are not bound together by the living hinge.

10. The storage apparatus for one or more key fobs according to claim wherein the base and the cover are formed from a single plate;

wherein the single plate allows the cover to fold on to the base to form the closed position;

wherein the single plate is a semi-rigid structure.

11. The storage apparatus for one or more key fobs according to claim wherein the master fastener is a hook and loop fastener;

wherein the hook and loop fastener attaches the edge of the cover that is distal from the bound edges to the edge of the base that is distal from the bound edges;

wherein the remaining edges of the cover and the base remain open into the interior of the containment structure when the storage apparatus for one or more key fobs is in the closed position.

* * * * *